United States Patent [19]

Stoecklin et al.

[11] 4,336,915

[45] Jun. 29, 1982

[54] CONSTRUCTION FOR WHISTLING AND SPARKLING KEEL KITE

[76] Inventors: Carl E. Stoecklin, 2996 Wardall Ave., Apt. 10, Cincinnati, Ohio 45211; John F. Stoecklin, 2717 Erlene Dr., Cincinnati, Ohio 45238

[21] Appl. No.: 139,992

[22] Filed: Apr. 14, 1980

Related U.S. Application Data

[63] Continuation-in-part of Ser. No. 123,384, Feb. 21, 1980, abandoned.

[51] Int. Cl.[3] ..... B64C 31/06

[52] U.S. Cl. ..... 244/153 R; 244/155 R

[58] Field of Search ..... 244/153 R, 153 A, 154, 244/155 R, DIG. 1; 46/48, 52, 58, 60, 61, 63; D21/88, 89, 90

[56] References Cited

U.S. PATENT DOCUMENTS

| | | | |
|---|---|---|---|
| 1,914,822 | 6/1933 | Bryan | 244/155 R |
| 2,445,611 | 7/1948 | Dunn | 244/153 A |
| 2,800,293 | 7/1957 | Kindelberger et al. | 244/155 R |
| 2,986,363 | 5/1961 | Vandergrift | 244/153 R |
| 3,153,877 | 10/1964 | Effinger et al. | 244/153 R |
| 3,305,198 | 2/1967 | Sellers | 244/153 R |
| 3,347,500 | 10/1967 | Hartig | 244/153 R |
| 3,570,792 | 3/1971 | Christoffel et al. | 244/153 R |

*Primary Examiner*—Charles E. Frankfort

*Attorney, Agent, or Firm*—James W. Pearce; Roy F. Schaeperklaus

[57] ABSTRACT

A keel kite including brackets slidably mounted on wing sticks thereof. The brackets are spanned by a cross brace telescopically mounted in and connecting the brackets. The brackets can be held at selected positions along the wing sticks. A kite string is attached to the keel. An opening in the keel receives an air activated sound making device mounted on a central keel stick of the kite. The sound making device is actuated by air passing the keel as the kite flies. The sound making device includes a spinner rotatably mounted in the opening in the keel. The spinner is of light reflective material. The body is transparent so that sunlight can be reflected from the spinner in a flashing or sparkling effect.

6 Claims, 15 Drawing Figures

FIG. 5
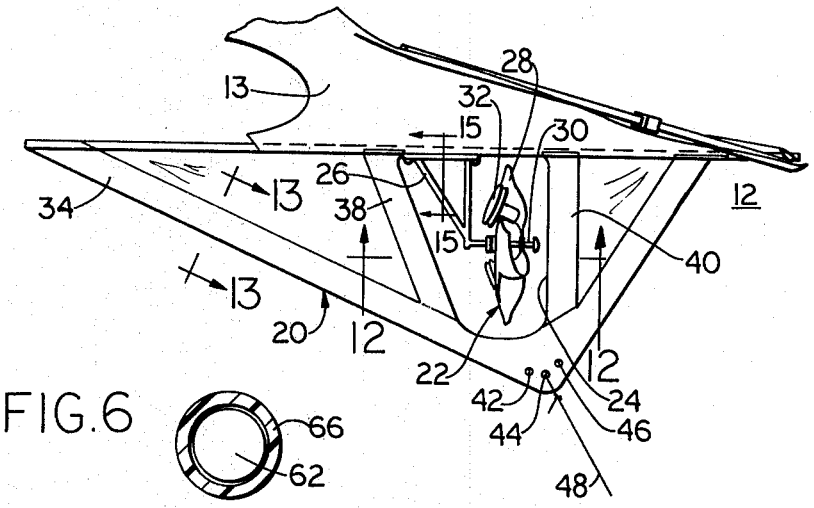
FIG. 9
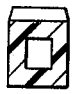
FIG. 10
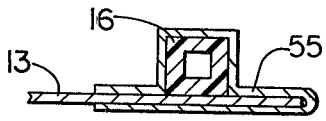
FIG. 6
FIG. 11
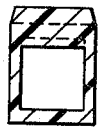
FIG. 7
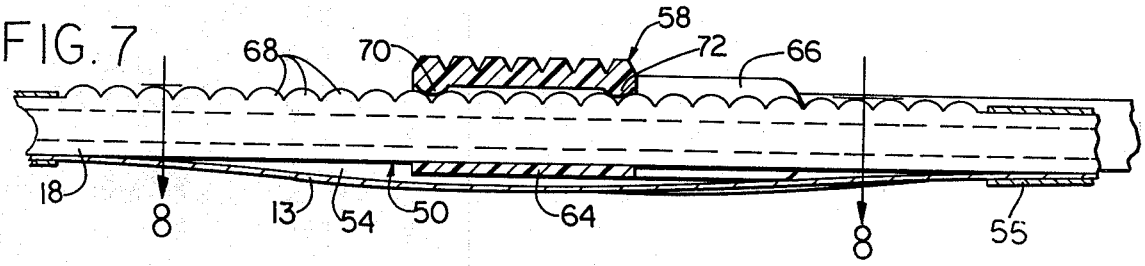
FIG. 8
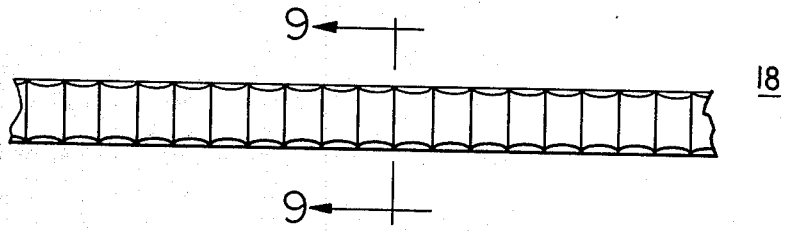
FIG. 12
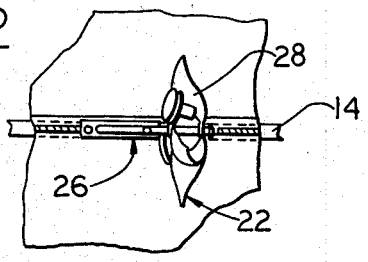
FIG. 13
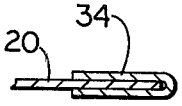
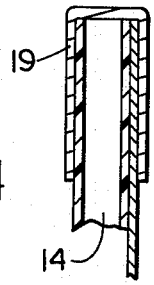
FIG. 14
FIG. 15
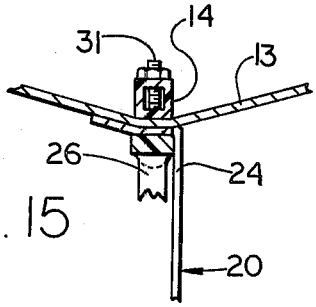

CONSTRUCTION FOR WHISTLING AND SPARKLING KEEL KITE

This is a continuation-in-part of our co-pending application No. 123,384 filed Feb. 21, 1980 and now abandoned.

This invention relates to kite structures. More particularly, this invention relates to a keel kite.

Keel kites have a tendency to loop to one side or the other. An object of this invention is to provide a keel kite which has a movable strut or cross brace which can be moved to selected positions so that the kite is balanced and is stabilized in flight.

A further object of this invention is to provide such a keel kite in which wing sticks carry brackets which are connected by a cross brace and in which the brackets are movable to selected positions for balancing the kite.

A further object of this invention is to provide a keel kite which includes a sound making device mounted in an opening in a keel thereof.

A further object of this invention is to provide such a keel kite in which the sound making device is of light reflecting material and is caused to spin as the kite flies and in which sunlight is reflected from the spinning sound making device to give a sparkling effect.

Briefly, this invention provides a keel kite which includes a generally triangular body having spar members or wing sticks mounted along two edges thereof. A cross brace spans the wing sticks. Brackets connect end portions of the cross brace to the wing sticks. Each bracket includes a first portion which is slidable along an associated wing stick and a second portion which telescopically receives an end portion of the cross brace. Means is provided for holding the brackets at selected positions along the associated wing sticks. The kite can include a central or keel stick which can be attached to the body opposite a keel portion of the kite. A sound maker can be mounted on the keel stick with the sound maker being in an opening in the keel so that the kite can emit a sound as it flies. The sound maker can include a spinner which is caused to turn by air passing the keel. The spinner can be of light reflective material, and the body can be transparent so that sunlight can pass through the body and can be reflected by the turning spinner to give a flashing effect.

The above and other objects and features of the invention will be apparent to those skilled in the art to which this invention pertains from the following detailed description and the drawings, in which:

FIG. 5 is a perspective view of the kite showing a portion of a kite string in association therewith;

FIG. 6 is a view in section taken on the line 6—6 in FIG. 3, a cross brace of the kite being shown;

FIG. 7 is a view in section taken on an enlarged scale on the line 7—7 in FIG. 1;

FIG. 8 is a fragmentary plan view of a wing stick of the kite looking in the direction of the arrows 8—8 in FIG. 7;

FIG. 9 is a view in section taken on the line 9—9 in FIG. 8;

FIG. 10 is a view in section taken on an enlarged scale on the line 10—10 in FIG. 1;

FIG. 11 is a view in section taken on the line 11—11 in FIG. 4;

FIG. 12 is a fragmentary view looking in the direction of the arrows 12—12 in FIG. 5;

FIG. 13 is an enlarged fragmentary view in section taken on the line 13—13 in FIG. 5;

FIG. 14 is an enlarged view in section taken on the line 14—14 in FIG. 1; and

FIG. 15 is a view on an enlarged scale in section taken on the line 15—15 in FIG. 5.

In the following detailed description and the drawings, like reference characters indicate like parts.

Figure 1:
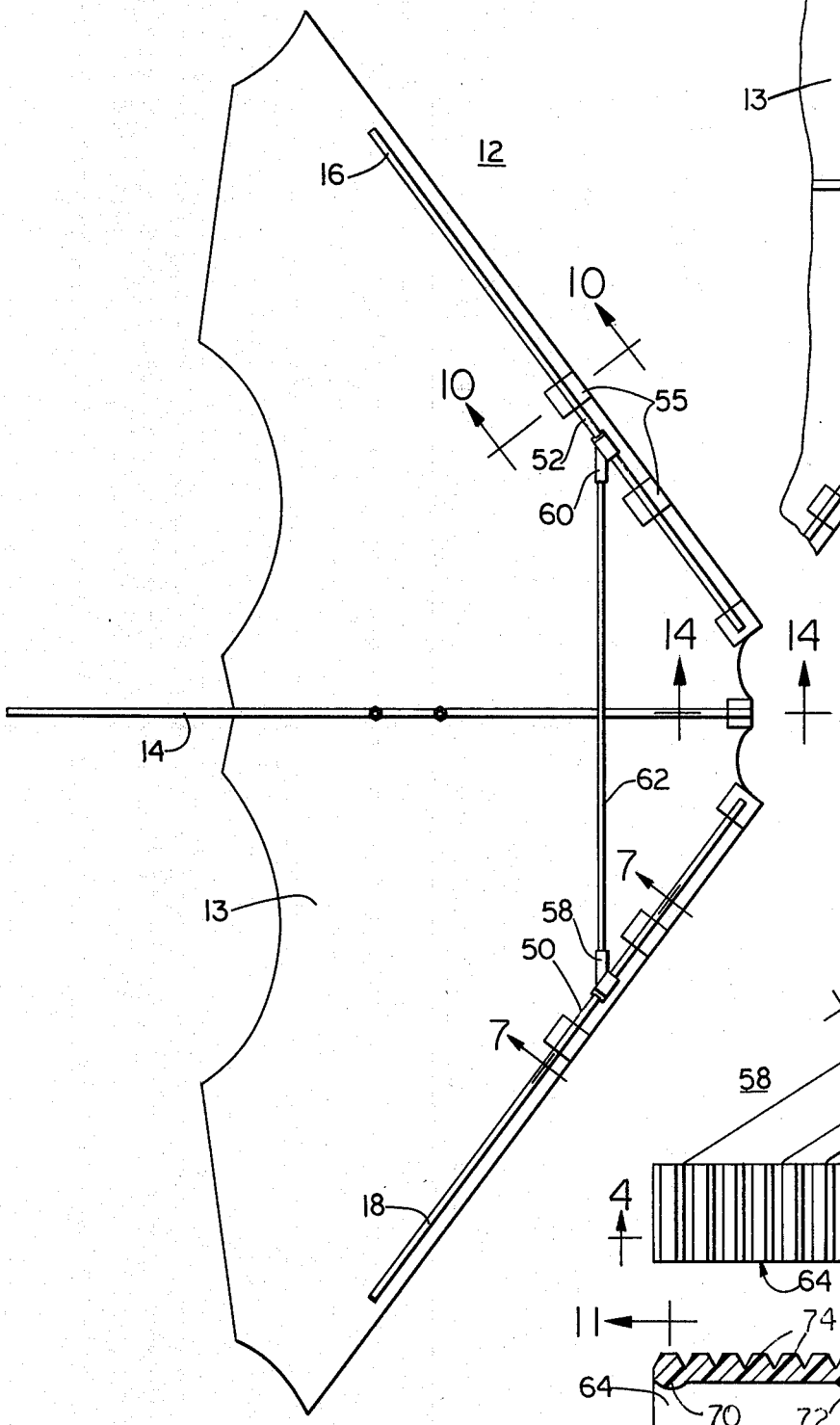
FIG. 1 is a top plan view of a keel kite constructed in accordance with an embodiment of this invention with a cross brace thereof in centered position.
Figure 2:
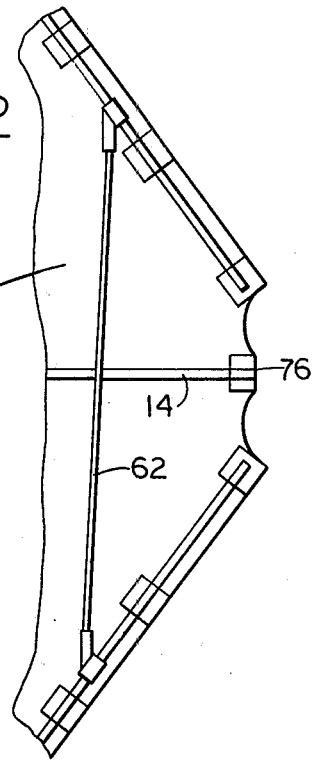
FIG. 2 is a fragmentary top plan view of the kite with the cross brace in an angled position.
Figure 3:
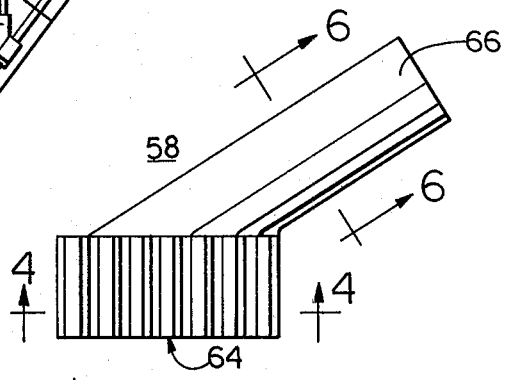
FIG. 3 is a plan view on an enlarged scale of a bracket of the kite.

IN FIGS. 1, 2 and 3 is shown a keel kite 12 constructed in accordance with an embodiment of this invention. The kite 12 includes a body 13 of sheet material secured to a keel stick 14 and wing sticks 16 and 18. The sheet material can be transparent. The keel stick 14 and the wing sticks 16 and 18 can be adhesively attached to the body 13. End portions of the keel stick and the wing sticks are held in position on the body 13 and reinforced by patch strips 19, one of which is shown in FIG. 14, which are adhesively attached thereto. An edge flange portion of a keel 20 of sheet material is secured to the body 13 along the keel stick 14. A sound making device 22 can be mounted on the keel stick 14 in an opening 24 in the keel 20. The noise making device can be similar in construction to the noise maker shown in our co-pending application Ser. No. 123,384 filed Feb. 21, 1980, and can include a bracket 26 and a spinner member 28 rotatably mounted on a strut 30 of the bracket 26. Fasteners 31 extend through the keel stick to support the bracket 26. Whistle members 32 are mounted on the spinner member 28 and can sound as the spinner member turns as air passes the spinner during flight of the kite. The spinner member can be of light reflective material so that sunlight which passes through the transparent body 13 is reflected by the turning spinner in a sparkling manner. As shown in FIGS. 5 and 13, a reinforcing strip 34 is provided along edges of the keel 20 and similar reinforcing strips 38 and 40 are provided along edges of the opening 24. Perforations 42, 44 and 46 are formed in the keel for attachment of a kite string 48.

Portions 50 and 52 of the wing sticks 18 and 16, respectively, are free of adjacent portions of the body to provide spaces 54 between the body 13 and the wing sticks, one of which is shown in FIG. 7. Ends of the spaces 54 are defined by patch strips 55 which are adhesively attached to the body 13 and the wing sticks. Brackets 58 and 60 are slidably mounted on the wing sticks 18 and 16, respectively, at the spaces 54. The brackets 58 and 60 telescopically support end portions of a cross brace 62.

Figure 4:
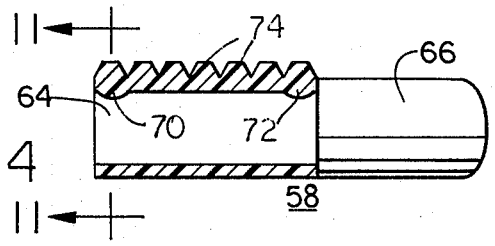
FIG. 4 is a view in section taken on the line 4—4 in FIG. 3.

Details of construction of the bracket 58 and the associated wing stick 18 are shown in FIGS. 3 and 4. The bracket 60 and the associated wing stick 16 are of similar construction. The bracket 58 includes a tubular body 64 and a tubular branch portion 66. The tubular body 64 receives the wing stick 18. The wing stick 18 is provided with a plurality of upstanding ribs 68. Ribs 70 and 72 are provided on the interior of the tubular body 64 and extend inwardly to engage the ribs 68 on the wing stick 18. The bracket 58 and the wing stick 18 can be formed of resilient material such as a resilient plastic so that the bracket 58 can be advanced along the wick stick 18 to a selected position along the wing stick and is held at the selected position. Ribs 74 are formed on the tubular body 64 for assistance in advancing the bracket 58. The tubular branch portion 66 receives an end portion of the cross brace 62 and loosely holds the cross brace 62.

Keel kites tend to swing or circle to the right or left in flight. If the present kite tends to swing to the left, the bracket 60 can be advanced toward a nose portion 76 of the kite to the position shown in FIG. 2, while the bracket 58 is advanced away from the nose portion 76 to the position shown in FIG. 2 to cause the kite to fly without swinging or circling to one side. If, on the other hand, the kite tends to swing to the right, the bracket 60 can be advanced away from the nose portion 76 and the bracket 58 can be advanced toward the nose portion 76. Preferably, the brackets are moved equal distances from a normal or centered position. The adjustment changes the angle of attack of sections of the kite on opposite sides of the keel stick. As the kite flies, wind passes lengthwise of the keel 20 to cause the spinner 28 to turn causing the whistling members 32 to sound. The kite string 48 can be attached at any selected one of the holes 42, 44 and 46 so that the attitude or angle of the kite to the horizontal can be the desired angle. Sunlight passing through the body 13 is reflected by the spinner to cause the kite to sparkle or flash in flight.

If it is desired to cause the kite to loop to the left or to the right, the brackets 58 and 60 can be advanced from the position at which the kite flies without swinging or looping to provide a strunt kite which can be controlled with a single kite string 48 to loop to one side or the other.

In view of the foregoing description of a preferred embodiment of our invention, those skilled in the art will recognize that the principles of the invention can be applied in various ways.

The kite illustrated in the drawings and described above is subject to structural modifications without departing from the spirit and scope of the appended claims.

Although the invention has been illustrated and described in connection with a single specific embodiment, it is to be understood that the inventive concept is not limited to the specific structure shown.

Having described our invention, what we claim as new and desire to secure by Letters Patent is:

1. A kite which comprises a pair of wing sticks, a body of sheet material secured to said wing sticks, a pair of brackets, means for mounting each bracket on one of the wing sticks for sliding therealong, a cross brace telescopically mounted in and connecting the brackets, the mounting means including first ratchet means on the bracket and second ratchet means on the associated wing stick, interengagement between the first and second ratchet means releasably holding the brackets at selected positions along the wing sticks, keel means mounted on the body between the wing sticks, and means for attaching a kite string to the keel means.

2. A kite as in claim 1 in which the first and second ratchet means include a pluraity of outwardly extending ribs on the wing sticks and inwardly extending rib means on the brackets engageable with the ribs on the wing sticks.

3. A kite as in claim 1 which includes a keel stick attached to the body along the keel means, there being an opening in the keel means underlying the keel stick, and an air activated sound making device mounted on the keel stick in the opening in the keel means to be actuated by air passing the keel means as the kite flies, the sound making device including a spinner frame mounted on the keel stick and in the opening in the keel means, axis means supported on the spinner frame, the axis means being substantially parallel to and spaced from the keel stick and aligned with the keel means, a rotating spinner head carried by the axis means, and a sound maker carried by the spinner head.

4. A kite as in claim 3 in which the spinner head is of light reflective material and the body is transparent so that sunlight can pass through the body to be reflected from the spinner head in a flashing effect.

5. A kite as in claim 1 in which the first and second ratchet means may be used to balance the kite for use in flight.

6. A kite as in claim 1 in which the first and second ratchet means may be used to unbalance the kite for use in flight to provide a stunt kite.

* * * * *